US006793392B1

(12) United States Patent
Porret et al.

(10) Patent No.: US 6,793,392 B1
(45) Date of Patent: Sep. 21, 2004

(54) SELF CLOSING BAG

(75) Inventors: Jean-Yves Porret, Gieres (FR); Claude Imbert, La Tronche (FR)

(73) Assignee: Becton Dickinson France S.A., Le Pont De Claix (FR)

( * ) Notice: Subject to any disclaimer, the term of this patent is extended or adjusted under 35 U.S.C. 154(b) by 0 days.

(21) Appl. No.: 09/623,926

(22) PCT Filed: Apr. 1, 1999

(86) PCT No.: PCT/FR99/00768

§ 371 (c)(1),
(2), (4) Date: Feb. 26, 2001

(87) PCT Pub. No.: WO99/51505

PCT Pub. Date: Oct. 14, 1999

(30) Foreign Application Priority Data

Apr. 3, 1998 (FR) ..... 98 04406

(51) Int. Cl.[7] ..... B65D 33/16
(52) U.S. Cl. ..... 383/61.1; 383/88; 383/93
(58) Field of Search ..... 383/61.1, 61.2, 383/63, 82, 87, 88, 89, 90, 36, 71, 93

(56) References Cited

U.S. PATENT DOCUMENTS 1,652,457 A * 12/1927 Reach ..... 383/40
3,406,746 A * 10/1968 Abildgaard ..... 165/46
3,998,304 A * 12/1976 Edgerton et al. ..... 190/107
4,184,596 A * 1/1980 Avery ..... 206/522
4,521,910 A * 6/1985 Keppel et al. ..... 383/10
5,108,195 A * 4/1992 Perron ..... 220/495.11
5,713,669 A * 2/1998 Thomas et al. ..... 383/204
5,816,709 A * 10/1998 Demus ..... 206/204
5,875,611 A * 3/1999 Plourde ..... 383/204
6,350,057 B1 * 2/2002 Forman ..... 383/61.2

* cited by examiner

*Primary Examiner*—Jes F. Pascua
(74) *Attorney, Agent, or Firm*—David M. Fortunato

(57) ABSTRACT

A bag comprising an envelope closed at one end by an end wall and delimiting a mouth at the other end, containing a charge capable of passing, for example under gravity, through said mouth, when said bag is in the inverted position, said envelope being shaped on itself at said mouth in order to close said bag.

At the opposite end to the end wall, the envelope is shaped on itself, in particular folded, to determine, without discontinuity:

an outer sleeve which is above the mouth when the bag is in the inverted position;

at least one inner closure fold;

a neck inside which the inner closure fold is located;

and at least one outer closure fold closing said neck.

1 Claim, 2 Drawing Sheets

SELF CLOSING BAG

This application is a 371 of PCT/FR99/00768 filed Apr. 1, 1999.

BACKGROUND OF THE INVENTION

The present invention relates to a bag for packaging or conditioning a charge of one or more products, which may, for example, flow out under gravity, whether this be a solid particulate product, for example a powder, or a single object or multiple objects packed loose.

DESCRIPTION OF THE PRIOR ART

More specifically, the invention involves bags which in general comprise an envelope closed at one end by an end wall and at the other end delimiting a mouth which, when opened, allows the charge to pass or pass through, the charge flowing for example under gravity when said bag is in the inverted position. Furthermore, the envelope is shaped on itself, especially folded, at the mouth in order to close this bag.

For a specific application, the applicant company is interested in a bag as previously defined, which meets the following requirements:

- that it can be opened with just one hand, by a simple gesture, without the operator or handler's hand coming into contact with the inside or the edge of the mouth, particularly in order to avoid any contamination of the latter;
- and, when in the inverted and unopened position, that it can clone itself under the effect of the charge of product contained in the bag, that is to say oppose the opening of the mouth under the effect of this same charge.

SUMMARY OF THE INVENTION

Having tried out various configurations or foldings of the bag envelope, at its mouth, the applicant company has discovered that the following shaping, obtained without discontinuity of the envelope and without any attached parts, sheets or walls, met the aforementioned requirements. This shaping, obtained by folding or folding over the envelope on itself, comprises:

- an outer sleeve which is above its mouth when said bag is in the inverted position, that is to say with its mouth lowermost;
- at least one inner closure fold;
- a neck inside which the inner closure fold is located;
- and at least one outer closure fold closing said neck.

Through various tests, the applicant company has also discovered that such a shaping additionally made it possible to obtain relative sealing at the closure of the mouth of the bag, particularly when this bag is placed inside another bag, itself on the outside, and when the two bags, the inner one and the outer one, are under partial vacuum.

BRIEF DESCRIPTION OF THE DRAWINGS

The present invention is now described with reference to the appended drawing, in which.

DESCRIPTION OF THE PREFERRED EMBODIMENTS

Figure 1:
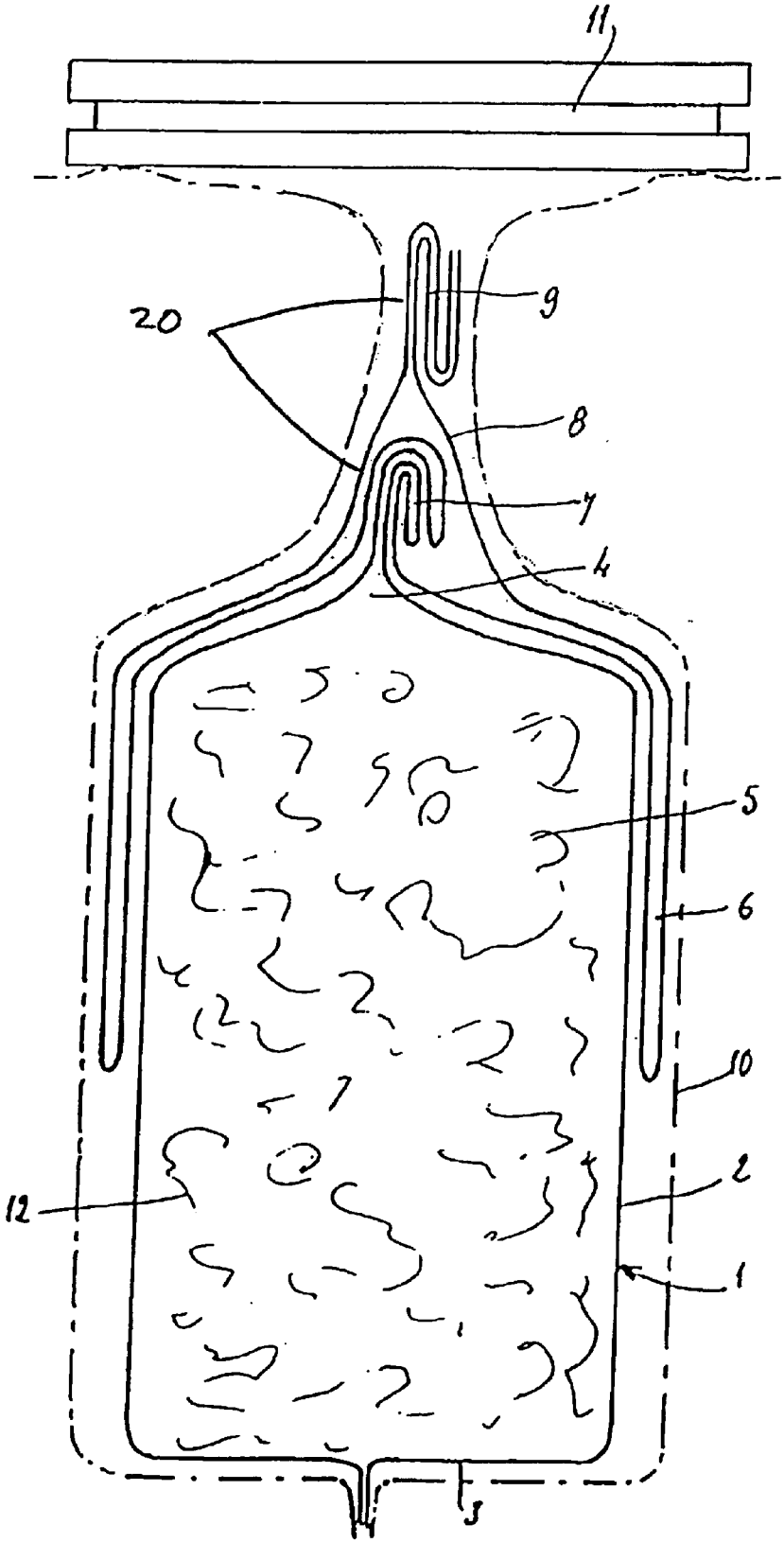
FIG. 1 depicts a use-once assembly intended, for example, to be coupled to a device for allowing communication with a fixed chamber, this assembly comprising an inner bag according to the invention.

In accordance with FIG. 1, there is depicted a use-once assembly intended to be coupled to a device for allowing communication with a fixed chamber, for example a clean or sterile room.

This assembly generally comprises:

- an outer bag 10 which may be under partial vacuum and has a flexible wall;
- a member 11 for shutting off the outer bag 10, comprising and this is not depicted, a removable shutter element with a sealing gasket;
- and an inner bag 1 which can also be under vacuum, placed inside the outer bag 10, containing a charge 12 of a product or loose objects.

The bag 1 comprises an envelope 2 which is closed at one end by an end wall 3 and at the other end delimits a mouth 4 which is closed thanks to the shaping of the envelope 2 as described hereafter, at this mouth.

As FIG. 1 shows, this shaping determines, without discontinuity of material or of the wall, but also without any attached sheets or other walls:

- an outer sleeve 6 located below mouth 4 when the bag is in a position, such that mouth 4 is uppermost;
- at least one inner closure fold 7;
- a neck 8 inside which the inner closure fold 7 is located;
- and at least one outer closure fold 9 closing said neck 8.

As FIGS. 2 to 7 show, this shaping is obtained as follows.

Figure 2:
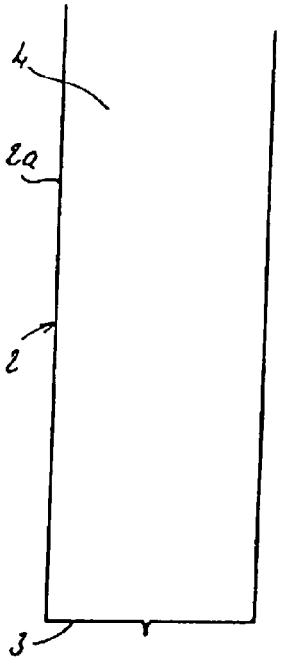
FIGS. 2 to 7 respectively depict the various steps involved in shaping the envelope of the bag, which envelope is filled with a charge (not depicted), in order to culminate in the shaping depicted in FIG. 1.

According to FIG. 2, the starting point is an envelope 2 with a closed end 3, in the shape of a bucket, determining an opening 4 with an upper and peripheral edge 2*a*.

Figure 3:
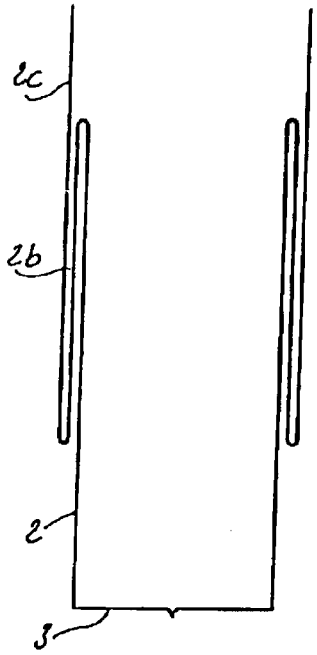

As FIG. 3 shows, the edges 2*a* of the opening 4 of the bag being formed are folded outward then inward in order to obtain a turned-up flap 2*b* extended by an outer envelope 2*c*.

Figure 4:
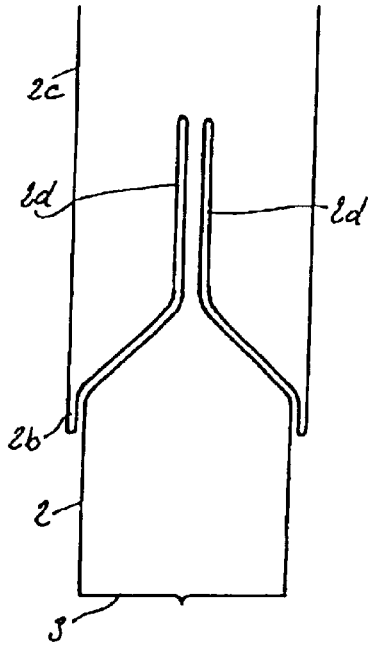
Figure 5:
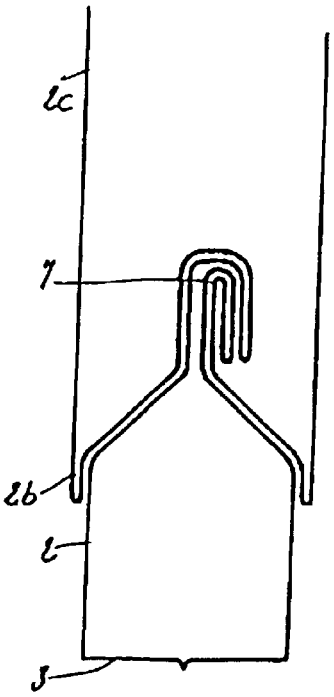

In accordance with FIGS. 4 and 5, the parallel edges 2*d* of the flap 2*b* are brought together and folded using any appropriate fold, to form at least one fold 7 for internally closing the bag.

Figure 6:
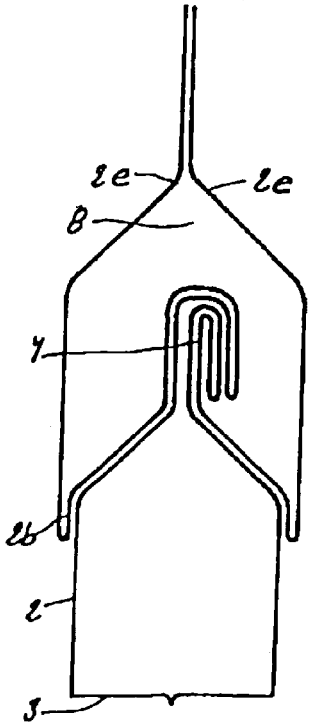

As shown by FIG. 6, it is the outer envelope 2*c* which makes it possible to obtain the neck 8 inside which the inner closure fold 7 is located.

Figure 7:
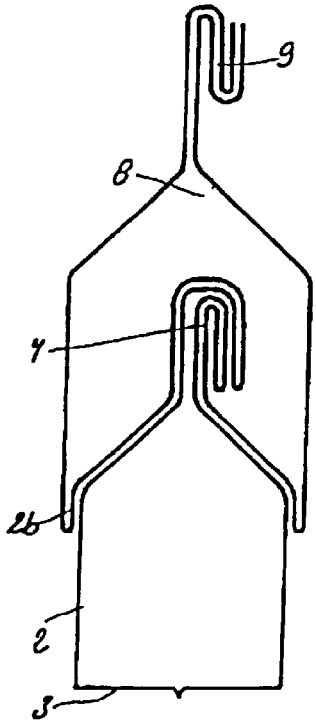

In accordance with FIGS. 6 and 7, the parallel edges 2*e* of the outer envelope 2*c* are folded to form at least one fold 9 for externally closing the bag.

If necessary, the inner closure fold 7 and the outer closure fold 9 may be supplemented, in order to keep them sealed, by any appropriate welding, bonding or clamping method or means, generally indicated as 20 in FIG. 1.

Of course, the envelope 2 is made of an appropriate material, for example any single or compound plastic, which intrinsically has the flexibility and sealing required for the application in question Thanks to the shaping according to the invention, and when the bag 1 is in the inverted position, the charge 12 tends to dilate the bag 2 and the sleeve 6. Because of its double thickness, the latter opposes this dilation and especially prevents the unfolding of the fold 7 under the effect of the charge.

With the shaping described earlier, by pulling on the outer fold 9 with just one hand, the entire envelope 2 is unfolded above the mouth 4 without making any openings at this mouth, for example by cutting or tearing, and therefore without being liable to contaminate the inside of the bag 1 on account of the manipulation for opening the latter.

What is claimed is:

1. A method of forming a bag for containing a charge, said method comprising the steps of:

(a) forming an envelope having a closed first end and an open second end having peripheral edges and being located apart from the first end and through which the charge may pass, the open second end having peripheral edges;

(b) shaping the envelope at the open second end to form a closure to the bag by performing the following steps: folding the peripheral edges of the open second end outward in a direction away from each other and away from the open second end;

folding the peripheral edges of the open second end, previously folded outward, inward in a direction toward each other and toward the open second end to form a turned-up flap and an outer envelope located proximal thereto, the turned-up flap having proximally located parallel edges and the outer envelope having proximally located parallel edges;

forming an inner closure fold for internally closing the bag by folding the proximally located parallel edges of the turned-up flap; and forming an outer closure for externally closing the bag by folding the proximally located parallel edges of the outer envelope.

* * * * *